US005797698A

United States Patent [19]

Barth et al.

[11] Patent Number: 5,797,698

[45] Date of Patent: Aug. 25, 1998

[54] PAVING ELEMENTS FOR THE WATER-PERMEABLE REINFORCEMENT OF SURFACES

[75] Inventors: Gunter Barth, Buhlertal; Michael Schmitz, Buhl, both of Germany

[73] Assignee: F. von Langsdorff Licensing Ltd., Inglewood, Canada

[21] Appl. No.: 629,890

[22] Filed: Apr. 10, 1996

[51] Int. Cl.[6] ..... E01C 5/00

[52] U.S. Cl. ..... 404/39; 404/42

[58] Field of Search ..... 404/39, 34, 38, 404/42; D25/113, 138, 157, 158, 159, 160, 161, 162

[56] References Cited

U.S. PATENT DOCUMENTS

| | | | |
|---|---|---|---|
| 456,378 | 7/1891 | Hurlbut | 404/39 |
| 572,762 | 12/1896 | Landers | 404/39 |
| 4,627,764 | 12/1986 | Scheiwiller | 404/39 |
| 4,761,095 | 8/1988 | Bartlechner | 404/41 |
| 5,348,417 | 9/1994 | Scheiwiller | 404/38 |
| 5,400,561 | 3/1995 | Metten | 405/19 X |

FOREIGN PATENT DOCUMENTS

| | | | |
|---|---|---|---|
| 252984 | 7/1964 | Austria | 404/39 |
| 812079 | 1/1937 | France | 404/34 |
| 3714418 | 11/1987 | Germany | 404/39 |
| 358597 | 11/1937 | Italy | 404/34 |
| 9432 | of 1842 | United Kingdom | 404/39 |
| 412004 | 6/1934 | United Kingdom | 404/34 |

*Primary Examiner*—William P. Neuder

*Attorney, Agent, or Firm*—Orrick, Herrington & Sutcliffe

[57] ABSTRACT

A paving element for the water-permeable reinforcement of surfaces, said paving element comprising a top surface, a bottom surface and a plurality of sides. One or more of the sides have vertical recesses extending from the top surface of the paving element to the bottom surface. The recesses are disposed asymmetrically about the mid points of the sides such that recesses of the adjacent sides of neighboring elements are offset from one another when the neighboring elements are laid in alignment, thereby avoiding alignment of the recesses. Alternatively, an offset of the recesses on neighboring stones is achieved by laying the elements in a displaced or staggered manner.

24 Claims, 9 Drawing Sheets

PAVING ELEMENTS FOR THE WATER-PERMEABLE REINFORCEMENT OF SURFACES

FIELD OF INVENTION

This invention relates to paving elements, particularly artificial stones made of concrete, to be used for the water-permeable reinforcement of surfaces.

BACKGROUND OF THE INVENTION

The use of artificial stones in various geometric shapes as paving elements to reinforce surfaces that are exposed to the weather such as streets, entranceways, court yards, roads, pavements, industrial yards and the like has been well known.

In connection with such surfaces, there has been an increasing requirement that they not be constructed as so-called sealed surfaces, but rather in such a way that surface water from rain can seep away. In order to achieve this, it is known, for example, either to provide the stones with vertical perforations, or to provide side-located cams so that the stones are spaced apart, or to form the outer contour of the stone in such a way that recesses on the stone sides are complementary with neighboring stones. These arrangements create drainage channels through which surface water can pass through to the ground beneath. In order not to disturb the impression of a closed upper surface for such coverings, and in order to ensure traffic safety, the channels may, for example, be filled with a mineral material such as sand.

In all the above cases, however, there is a common disadvantage that the passageways, and thus the perforations opening upwardly through the top surface, have a large cross-section, because of a desire to be able to handle large amounts of precipitation without problem. However, walking over such a surface wearing shoes with narrow high heels is risky, because the heels can sink into the filling material of the channels and get stuck there because of tilting. The same applies to children's wagons or shopping carts with small wheels, particularly if, as the surface is used, the filling material of the channels no longer reaches fully to the upper surface. A further disadvantage consists in the aesthetic impairment of the surface due to the relatively large openings compared to the stone format. Calming laying patterns cannot be attained in this way.

SUMMARY OF INVENTION

It is, therefore, an object of the present invention to provide a paving element of the kind described above in such a way that the traffic-bearing capacity of a surface made with such elements is clearly improved.

Another object of the present invention is to provide a paving element which allows for drainage of surface water while maintaining the impression of a non-perforated upper surface.

Yet another object of the present invention is to provide a paving element which allows for drainage of surface water while attaining an aesthetic surface effect.

These and other objects are achieved in accordance with the present invention by paving elements in which at least one side of each element includes vertical recesses extending from the top surface of the element to the bottom surface. The recesses are displaced asymmetrically along the side of the element such that recesses of the adjacent sides of neighboring elements are offset from one another when the neighboring elements are laid in alignment, thereby avoiding alignment of the recesses.

In another embodiment of the present invention, an offset of the recesses on neighboring stones is achieved by laying the elements in a displaced or staggered manner.

These and other objects, features and advantages of the present invention will be apparent and fully understood from the following detailed description of the preferred embodiment, taken in connection with the appended drawings.

BRIEF DESCRIPTION OF THE DRAWINGS

The present invention can be better understood when considered with the following drawings wherein corresponding elements are identified with like reference numerals and wherein.

DETAILED DESCRIPTION

Figures 1, 2, 3, 4, 5, 6, 7, 8, 9, 10, 11, 12:
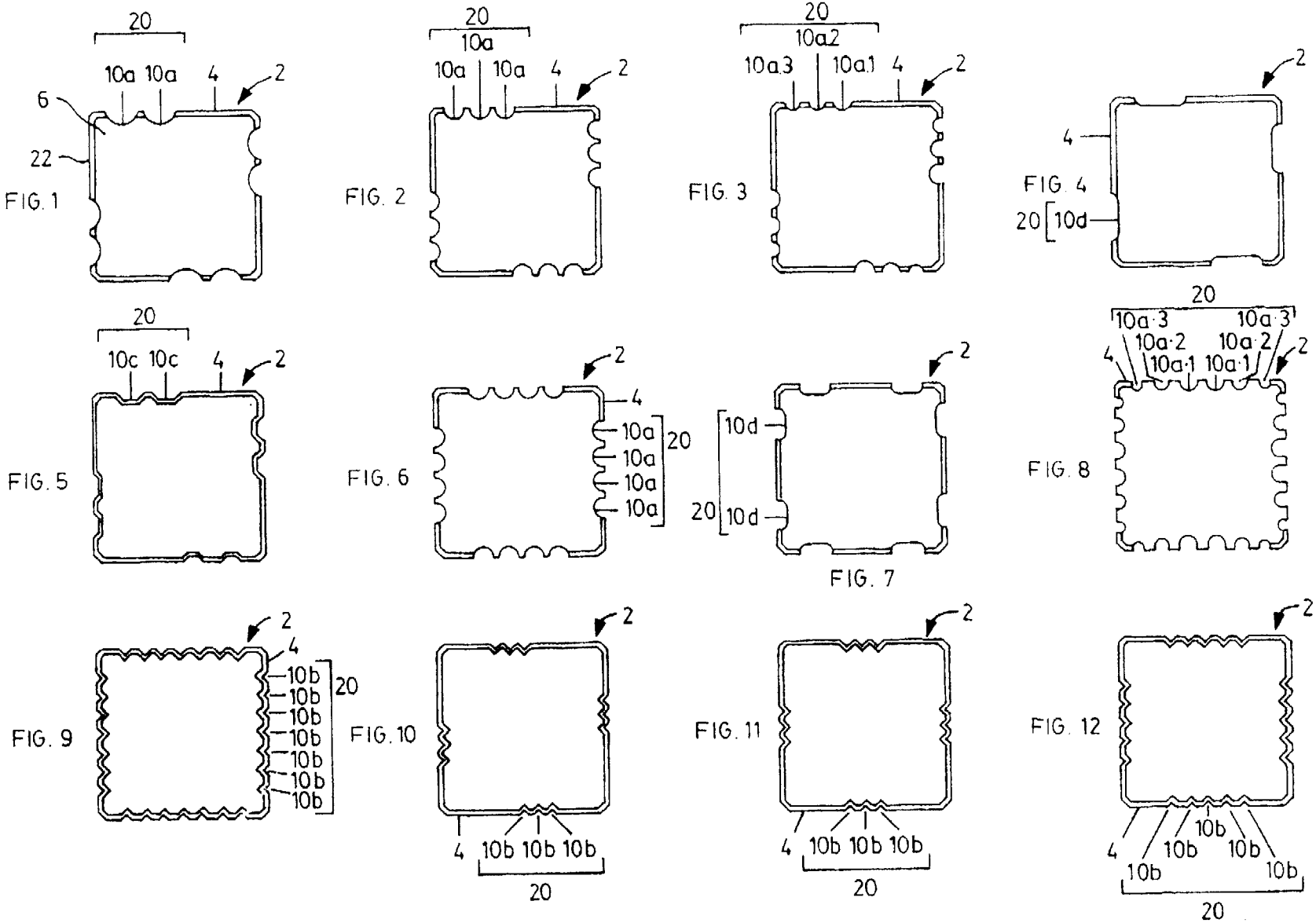
FIGS. 1 to 18 are top plan views of square paving elements according to the present invention.

The paving elements of the present invention are preferably formed of artificial stone, in particular concrete. The cross-sectional shape of the stones can basically have any desired periphery, as long as all sides of the various stones may be juxtaposed against the sides of suitable neighboring stones such that a paved surface is formed. However, for the pleasing configuration of a surface with regard to the direction of the lines, it is preferable for the stones to have a cross-section of which the outline is rectangular, square or polygonal. FIGS. 1–18 show square paving elements according to the present invention, while FIGS. 19–32 illustrate rectangular, FIGS. 33–40 illustrate hexagonal and FIGS. 41–51 illustrate L-shaped paving elements, all according to the present invention.

With reference to FIGS. 1–5, 10, 17, 20, 23, 25, 27–31, 33–34, 36–37, 40–44, 46–47, 49 and 51, in a first aspect of the present invention, the stones 2 include at least one side 4 which has one or more vertical recesses 10 extending from the top surface 6 of the stone 2 to the bottom surface. The recesses 10 are displaced along the side 4 of the stone 2 such that recesses 10 of the adjacent sides 4 of neighboring stones 2 are offset from one another when the neighboring stones 2 are laid in alignment, thereby avoiding alignment of the recesses 10. This characteristic allows a substantial reduction in the total recess cross-section. The desired recess layout may be achieved by disposing the recesses 10 asymmetrically about the mid point of the side 4. FIG. 52 illustrates a paved surface constructed with the paving elements of FIG. 1 in accordance with the first aspect of the present invention. It should be apparent, however, that any of the paving elements illustrated in FIGS. 2–5, 10, 17, 20, 23, 25, 27–31, 33–34, 36–37, 40–44, 46–47, 49 and 51 may be similarly employed.

A further reduction in the total recess cross-section can be attained according to the present invention by increasing the number of recesses 10. By using both factors, the individual cross-sections can be made so small that even shoes with stiletto heels no longer run the risk of sinking in and getting stuck. In this manner, the drainage of large quantities of surface water is also ensured without disturbing the appearance of a closed surface. In addition, this leads to an emphasis on the visual impression of a desired contour line for the sides of the stones.

Surfaces on which great demands are made in terms of carrying traffic and an appealing configuration, are mainly used for sidewalks and light traffic, so that the reduction of the contact areas which transfer the force from stone to stone, can be taken into account in terms of the increase in the number of recesses. It is therefore possible for the individual sides 4 of each stone 2 to have a plurality of adjacently lying recesses 10. Such plural recesses 10 can be arranged in groups 20. See, e.g., FIG. 9.

Further, it is possible for the recesses 10 to have differing horizontal cross-sections, whereby the visual impression of the surface can be given additional form. For example, the recesses 10*a*.1, 10*a*.2 and 10*a*.3 of the stone 2 in FIG. 3 progressively decrease in cross-sectional area. It is important, however, that the total cross-section of the recesses per unit surface area be sufficient to ensure the drainage of an expected quantity of surface water.

As to the cross-sectional formation of the recesses 10, there are no basic limitations so long as the technical creation thereof is possible. Preferably, the cross-section of such a recess 10 is a semicircle (e.g., recess 10*a* in FIG. 1), a triangle (e.g., recess lob in FIG. 9), a trapezoid (e.g., recess 10*c* in FIG. 5), a rectangle (e.g., recess 10*e* in FIG. 19) or a rectangle with rounded corners (e.g., recess 10*d* in FIG. 13). Within the framework of the invention it is provided that one side 4 of a stone 2, several sides 4 or even all of the sides 4 of a stone 2 are provided with one or more sets of recesses 20, wherein each set of recesses 20 includes one or more recesses 10.

The upper edge of the sides 4 of the stones 2 of the present invention may optionally include a bevel 22, this being used for both functional and aesthetic reasons. This bevel 22 aids in directing water from the top surface 6 of the stones 2 to the recesses 10, thereby allowing for quicker drying of the paved surface. See, e.g., FIG. 1. For aesthetic reasons, this bevel 22 can be so configured that the recesses 10 reach only to the region of the bevel 22 and therefore do not open through the top surface 6 of the stone 2. See FIG. 51.

In a first embodiment of the first aspect of the present invention, shown in FIGS. 1–18, the paving element 2 is square.

FIG. 1 shows a square artificial stone 2, which is provided on all four sides 4 with pairs of semicircular recesses 10*a*. The recesses 10*a* are offset to one side with respect to the mid point of each side 4, the displacement in this case being toward the right when viewed from the side, so that when such stones 2 are laid in transversely and longitudinally extending rows, the recesses 10*a* in each case abut against a portion of the side 4 of a neighboring stone 2 which is free of recesses. The recesses 10*a* have such a cross-section that the traffic-bearing capability of a surface built with the stones 2, even under unfavorable conditions, is not impaired, for example by way of shoes with narrow heels.

In a first variant of the first embodiment shown in FIG. 2, each set of recesses 20 includes three identical semicylindrical recesses 10*a* offset to one side of the mid point of each side 4.

In a second variant of the first embodiment shown in FIG. 3, each set of recesses 20 includes three semicylindrical recesses 10*a*.1, 10*a*.2 and 10*a*.3 offset to one side of the mid point of each side 4, each having different horizontal cross-sections, in this case progressively diminishing from recess 10*a*.1 to recess 10*a*.3.

In the third variant of the first embodiment shown in FIG. 4, each set of recesses 20 includes an elongate rectangular recess 10*d* with rounded part-cylindrical ends. Each of the recesses 10*d* is offset from the mid point of the respective side 4.

A fourth variant of the first embodiment is shown in FIG. 5, in which each set of recesses 20 includes a pair of trapezoidal recesses 10*c* offset from the mid point of each side 4.

A fifth variant of the first embodiment is shown in FIG. 6, in which each set of recesses 20 includes four semicylindrical recesses 10*a* located centrally on each side 4. Because the recesses 10*a* are centrally located, the stones 2 themselves must be laid in a staggered manner in order to avoid registry of the recesses 10*a* with correspondingly positioned recesses 10*a* of a neighboring stone 2.

FIG. 7 shows a sixth variant of the first embodiment, in which a pair of rectangular recesses 10*d* having curved part-cylindrical ends are symmetrically disposed about the mid point of each side 4.

FIG. 8 shows the seventh variant of the first embodiment, in which each set of recesses 20 includes six semicylindrical recesses 10*a*.1, 10*a*.2 and 10*a*.3 located centrally on each side 4. The recesses have different horizontal cross-sections progressively diminishing from recess 10*a*.1 to recess 10*a*.3.

FIG. 9 shows an eighth variant of the first embodiment in which each set of recesses 20 includes a plurality of triangular recesses 10*b* centrally disposed on each side 4.

FIG. 10 shows an ninth variant of the first embodiment in which each set of recesses 20 includes three triangular recesses 10*b* off set from the mid point on each side 4.

A tenth variant of the first embodiment shown in FIG. 11 is identical to the ninth embodiment shown in FIG. 10, except the recesses 10*b* centrally disposed on each side 4.

An eleventh variant of the first embodiment shown in FIG. 12 is identical to the tenth embodiment shown in FIG. 11, except each set of recesses 20 includes five triangular recesses 10*b*.

Figure 13:
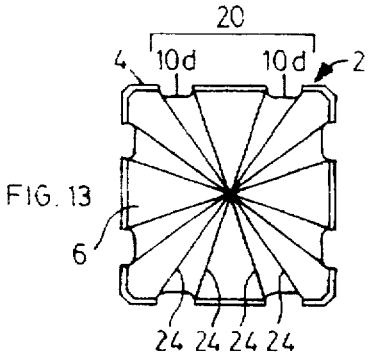

FIG. 13 is a plan view of the twelfth variant to the first embodiment, in which each set of recesses 20 includes a pair of rectangular recesses 10*d* with part-cylindrical ends symmetrically disposed on each side 4. In addition, the stone 2 includes grooves 24 in the top surface 6 extending radially from a central point of the top surface 6 to terminate at the outer edges of each recess 10*d*. These grooves 24, ensure quick drying of a stone, as well as add to the aesthetic nature of the paved surface.

Figure 14:
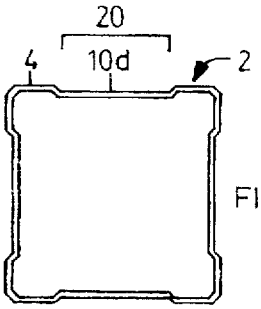

FIG. 14 is a plan view of the thirteenth variant of the first embodiment, in which each recess 10*d* is an elongate shallow rectangular depression centered on the mid point of each side 4.

Figure 15:
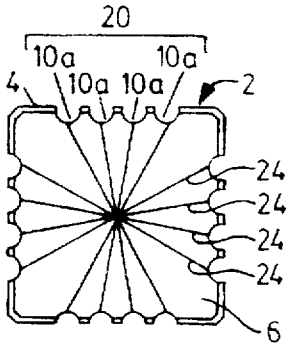

FIG. 15 is a plan view of the fourteenth variant of the first embodiment, in which each set of recesses 20 includes four semicylindrical recesses 10*a* symmetrically located on each side 4 with a radial groove 24 extending from the center point of the top surface 6 to the mid point of each semicylindrical recess 10*a*.

Figure 16:
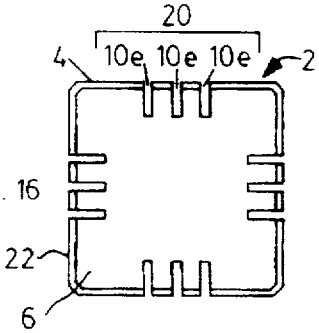

FIG. 16 is a plan view of the fifteenth variant to the first embodiment, in which each set of recesses 20 is centered on the mid point of each side 4 and includes three elongate rectangular slots 10*e* of equal depth.

Figure 17:
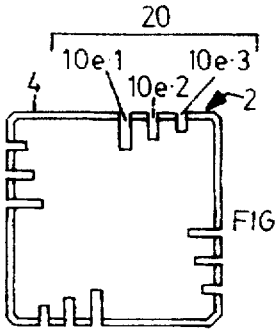

FIG. 17 is a plan view of the sixteenth variant to the first embodiment, in which each set of recesses 20 includes three rectangular recesses 10e.1, 10e.2 and 10e.3 of varying depths, each set of recesses 20 being offset from the mid point of the sides 4. The depth of each recess decreases progressively from recess 10e.1 to recess 10e.3.

Figure 18:
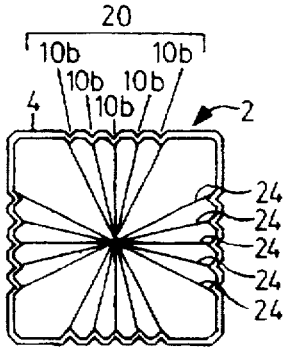

FIG. 18 is a plan view of a seventeenth variant to the first embodiment, in which each set of recesses 20 is a set of five centrally located triangular recesses 10b with radial grooves 24 extending from the center point of the top surface 6 to the apex of each of the triangular recesses 10b.

A second embodiment of the present invention is shown in FIGS. 19 through 32, in which the paving element is rectangular having, in the present case, a dimension in one direction which is twice that of the stones illustrated in FIGS. 1 through 18. In each case illustrated by FIGS. 19 through 32, longest sides 4a of the stone 2 have two sets of recesses 20 disposed on each while the shorter sides 4b have one set of recesses 20 on each.

Figure 19:
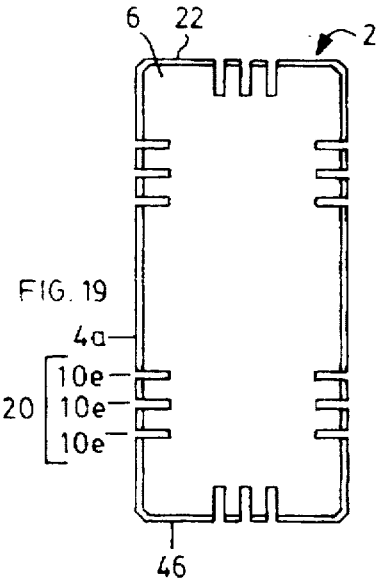
FIGS. 19 to 32 are top plan views of rectangular paving elements according to the present invention.

FIG. 19 is a plan view, in which the sets of recesses 20 are symmetrically disposed along the sides 4a and 4b. Each set of recesses 20 includes three rectangular slots 10e of uniform depth.

Figure 20:
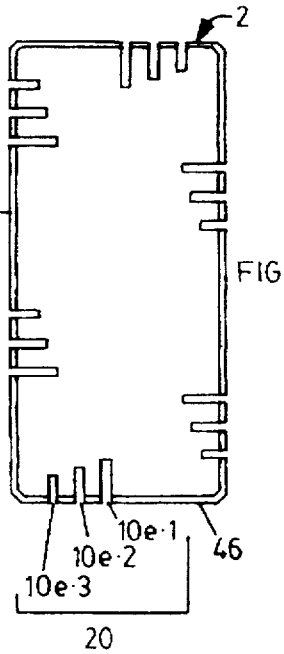

The first variant shown in FIG. 20 is similar to FIG. 19 except that in each set of recesses 20 the rectangular slots 10e.1, 10e.2 and 10e.3 progressively diminish in depth from slot 10e.1 to slot 10e.3. In addition, the sets of recesses 20 are asymmetrically disposed along the sides 4a and 4b.

Figure 21:
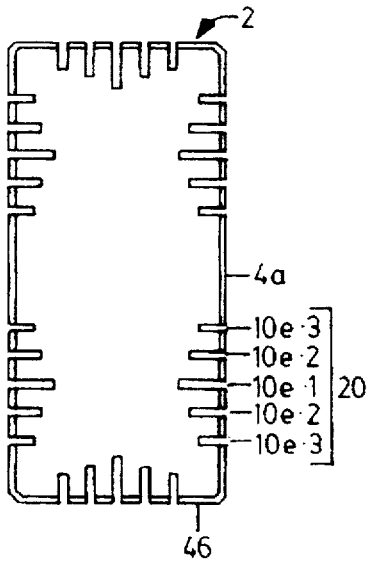

In the second variant of the second embodiment shown in FIG. 21, each set of recesses 20 includes a plurality of rectangular slots 10e.1, 10e.2 and 10e.3 of varying depth with the deepest slot 10e.1 being centrally located in the set 20. The sets of recesses 20 are symmetrically disposed along the sides 4a and 4b.

Figure 22:
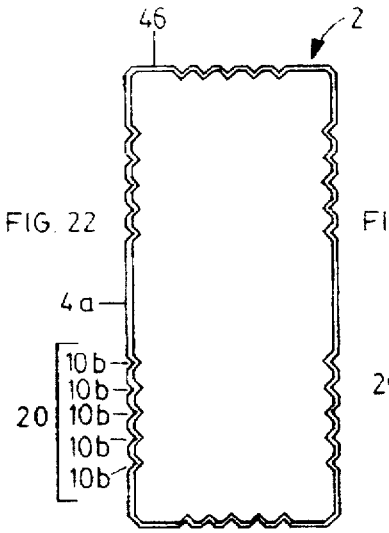

In a third variant of the second embodiment shown in FIG. 22, each set of recesses 20 includes a plurality of triangular indentations 10b. Once again, the sets of recesses 20 are symmetrically disposed along the sides 4a and 4b.

Figure 23:
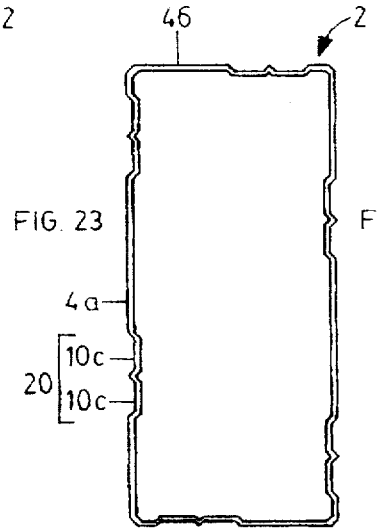

In a fourth variant of the second embodiment shown in FIG. 23, each set of recesses 20 includes a pair of trapezoidal recesses 10c. The sets of recesses 20 are disposed asymmetrically on sides 4a and 4b.

Figure 24:
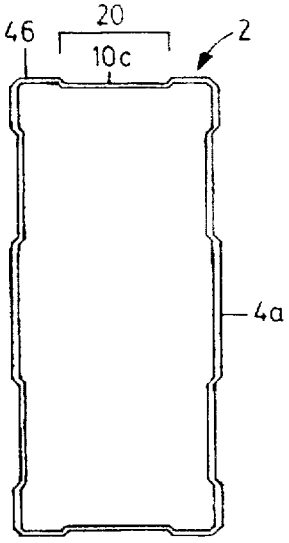

In a fifth variant shown in FIG. 24, each set of recesses 20 is formed as a single elongate trapezoidal recess 10c. The recesses 10c are symmetrically disposed along the sides 4a and 4b.

Figure 25:
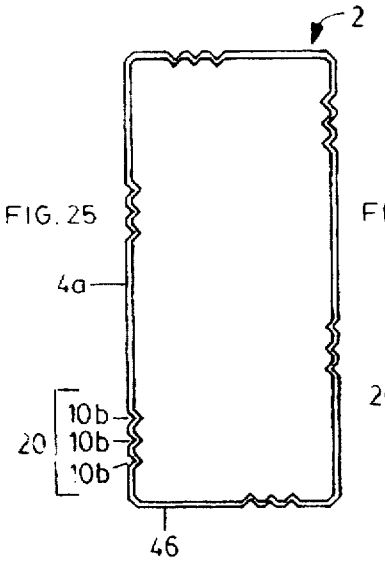

In a sixth variant shown in FIG. 25, each set of recesses 20 includes three triangular indentations 10b. The sets of recesses 20 are disposed asymmetrically on the sides 4a and 4b.

Figure 26:
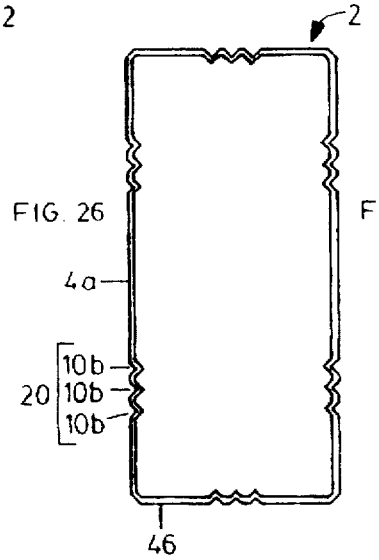

A seventh variant shown in FIG. 26, is similar to that shown in FIG. 25 except the sets of recesses 20 are symmetrically disposed on sides 4a and 4b.

Figure 27:
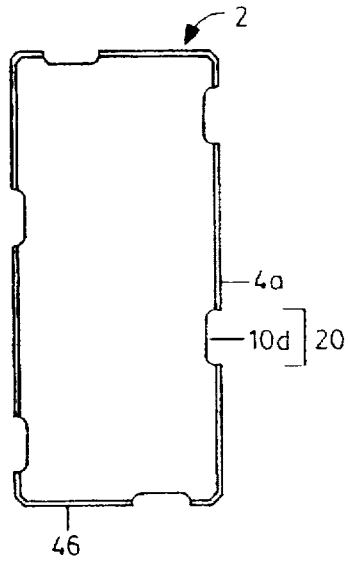

In an eighth variant shown in FIG. 27, each set of recesses 20 includes a rectangular recess 10d having curved part-cylindrical ends with the recesses disposed asymmetrically on sides 4a and 4b.

Figure 28:
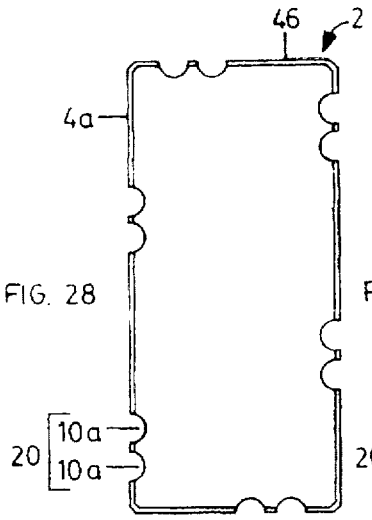

In a ninth variant to the second embodiment shown in FIG. 28, each set of recesses 20 includes a pair of semicylindrical recesses 10a with the recesses asymmetrically disposed on sides 4a and 4b.

Figure 29:
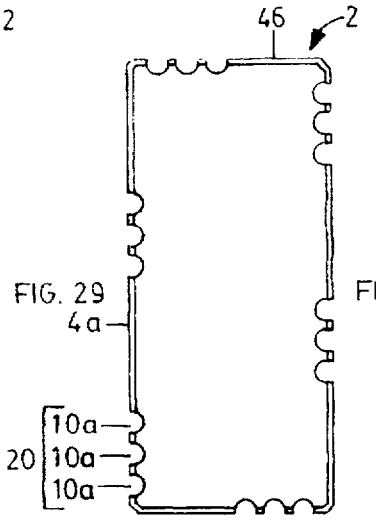

A tenth variant to the second embodiment shown in FIG. 29 is similar to the stone 2 depicted in FIG. 28 except each set of recesses 20 includes three semicylindrical recesses 10a rather than two.

Figure 30:
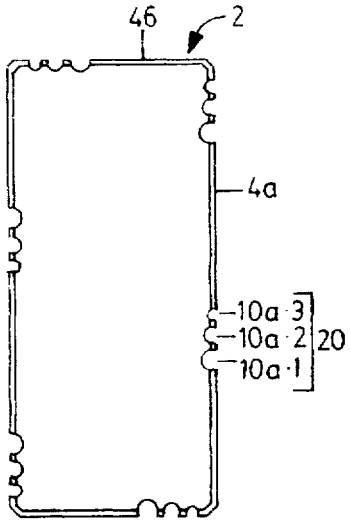

An eleventh variant of the second embodiment shown in FIG. 30 is similar to that shown in FIG. 29 except the three semicylindrical recesses 10a.1, 10a.2 and 10a.3 contained in each set of recesses 20 have progressively decreasing horizontal cross-sections.

Figure 31:
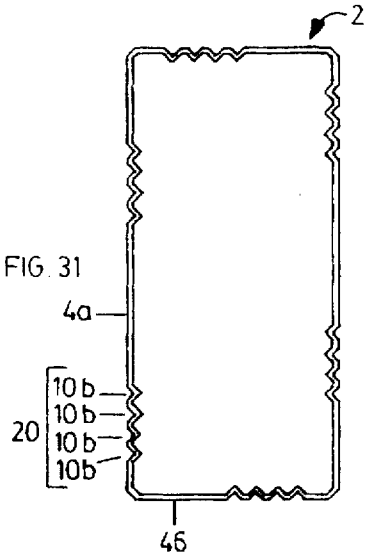

In a twelfth variant of the second embodiment shown in FIG. 31, each set of recesses 20 includes a plurality of triangular recesses 10b asymmetrically disposed on sides 4a and 4b.

Figure 32:
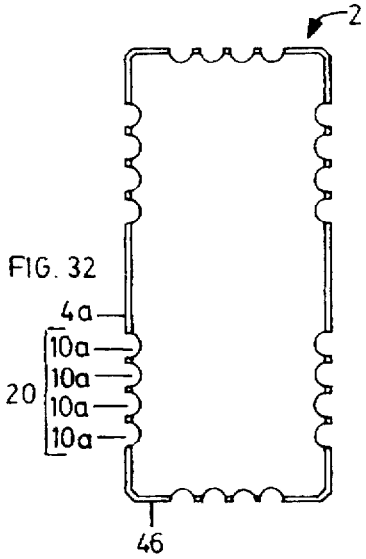

In a thirteenth variant to the second embodiment shown in FIG. 32, each set of recesses 20 includes four semicylindrical recesses 10a with the sets 20 symmetrically disposed on sides 4a and 4b.

In a third embodiment shown in FIGS. 33 through 40, the paving element is hexagonal in plan and each side 4 includes one set of recesses 20 disposed thereon.

Figures 33, 34, 35, 36, 37, 38, 39, 40:
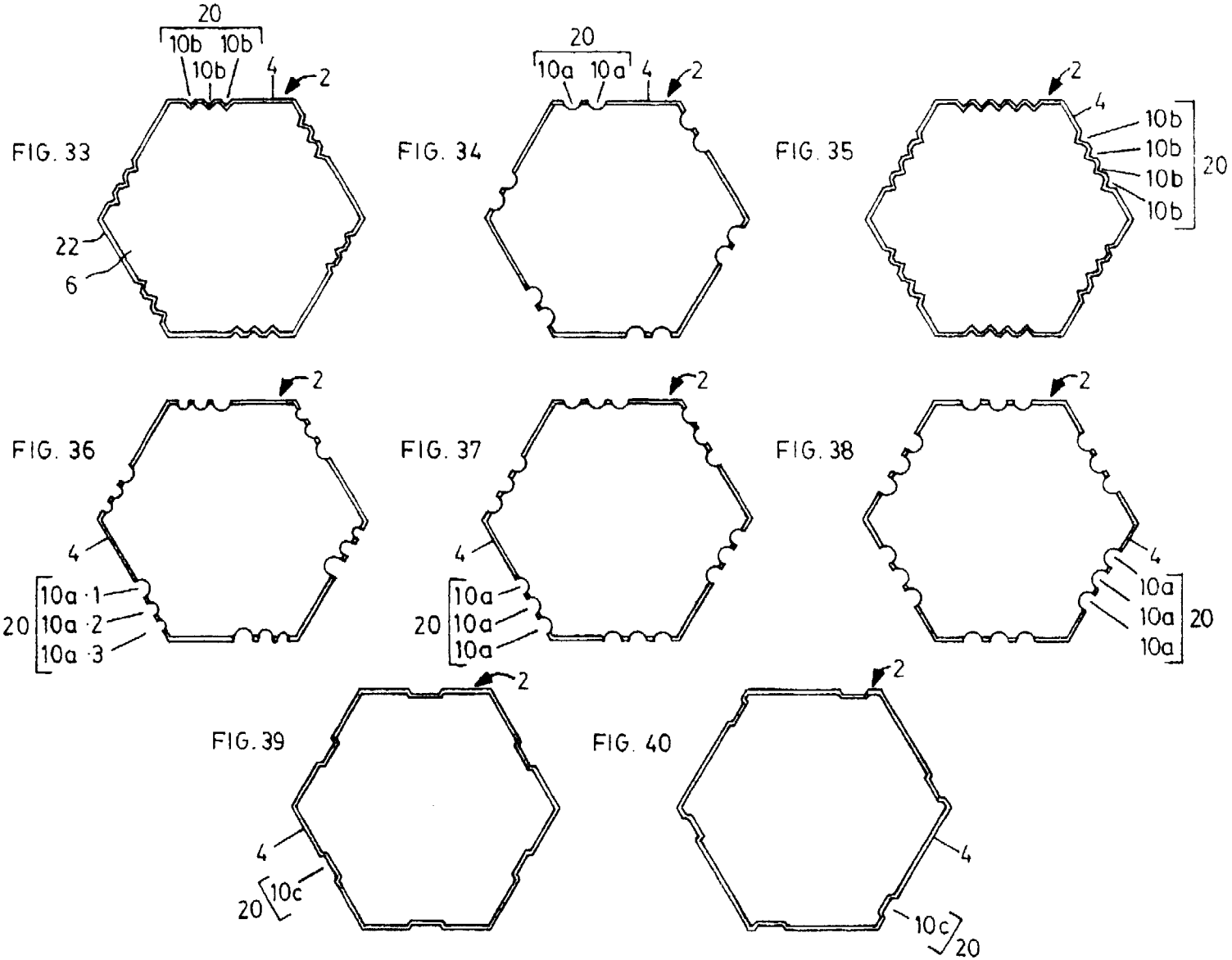
FIGS. 33 to 40 are top plan views of hexagonal paving elements according to the present invention.

In FIG. 33, each set of recesses 20 includes three triangular recesses 10b asymmetrically disposed on each side 4.

In the first variant of the third embodiment shown in FIG. 34, each set of recesses 20 includes two semicylindrical recesses 10a asymmetrically disposed on each side 4.

In a second variant of the third embodiment shown in FIG. 35, each set of recesses 20 includes four triangular recesses 10b centered on each side 4.

In a third variant of the third embodiment shown in FIG. 36, each set of recesses 20 includes three semicylindrical recesses 10a.1, 10a.2 and 10a.3 of progressively diminishing diameters with each set 20 offset on a side 4.

In a fourth variant to the third embodiment shown in FIG. 37, each set of recesses 20 includes three semicylindrical recesses 10a of uniform diameter and offset toward on side 4.

In a fifth variant to the third embodiment shown in FIG. 38, each set of recesses 20 includes three semicylindrical recesses 10a centered on each side 4.

In a sixth variant of the third embodiment shown in FIG. 39, each set of recesses 20 includes a single trapezoidal recess 10c centered on each side 4 of the hexagonal element 2.

A seventh variant of the third embodiment shown in FIG. 40 is similar to that shown in FIG. 39, except each trapezoidal recess 10c is offset on side 4.

In a fourth embodiment shown in FIGS. 41 through 45, the paving element 2 is L-shaped in plan view with the top surface 6 optically sub-divided by false joints 26 into three square areas. This results in the appearance of three separate stones and simplifies the task of building a surface. In each case, the longest sides 4a of the stone 2 have two sets of recesses 20 disposed on each while the shorter sides 4b have one set of recesses 20 on each.

Figure 41:
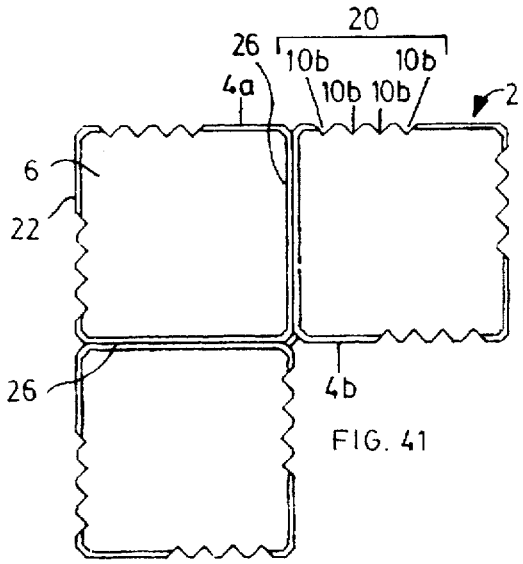
FIGS. 41 to 51 are top plan views of L-shaped paving elements according to the present invention.

In FIG. 41, each set of recesses 20 includes four triangular recesses 10b asymmetrically disposed on sides 4a and 4b.

Figure 42:
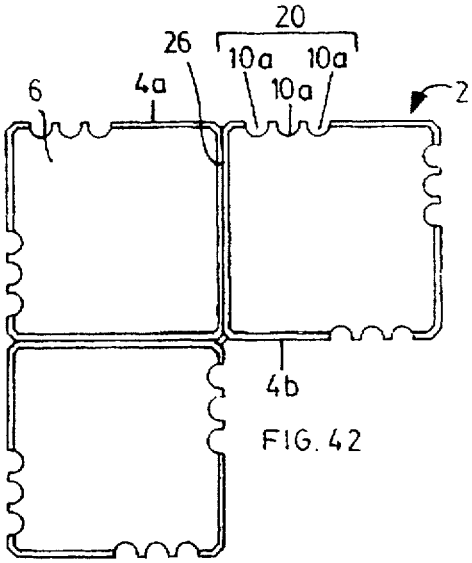

A first variant of the fourth embodiment shown in FIG. 42 is similar to that shown in FIG. 41, however, each set of recesses 20 includes three semicylindrical recesses 10a.

Figure 43:
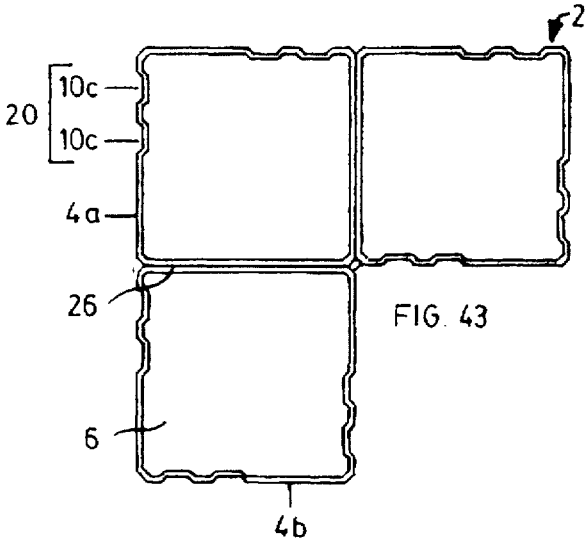

In a second variant to the fourth embodiment shown in FIG. 43, each set of recesses 20 includes a pair of trapezoidal recesses 10c asymmetrically disposed on sides 4a and 4b.

Figure 44:
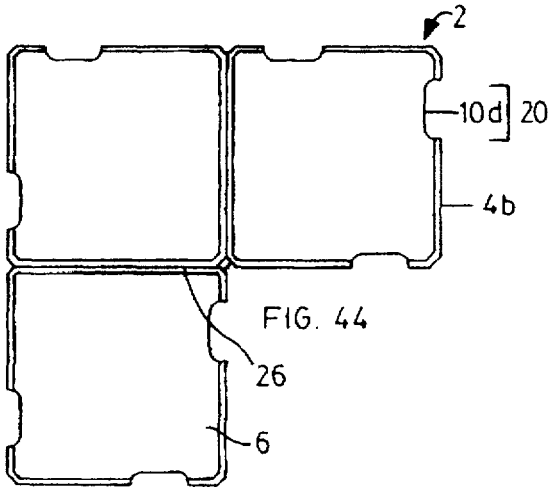

In a third variant to the fourth embodiment shown in FIG. 44, each set of recesses 20 includes a rectangular recess 10d having part-cylindrical end walls asymmetrically disposed on sides 4a and 4b.

Figure 45:
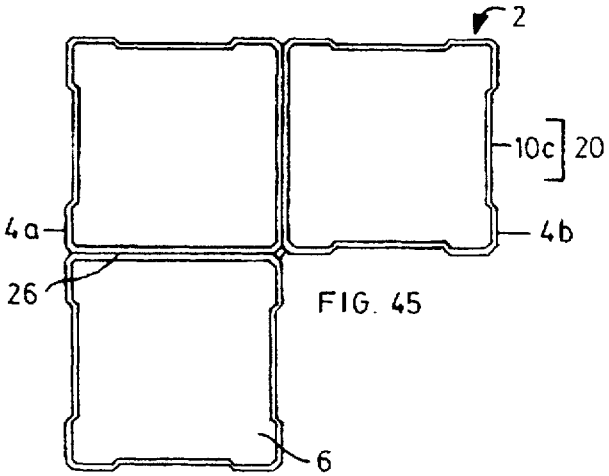

In a fourth variant of the fourth embodiment shown in FIG. 45, each set of recesses 20 includes an elongate trapezoidal recess 10c centered on each sub-divided area of the paving element 2.

A fifth embodiment, shown in FIGS. 46 through 50, is similar to the fourth embodiment, except that one of the false joints 26 is displaced thereby optically dividing the stone into one square and two rectangular areas instead of three square areas.

Figure 46:
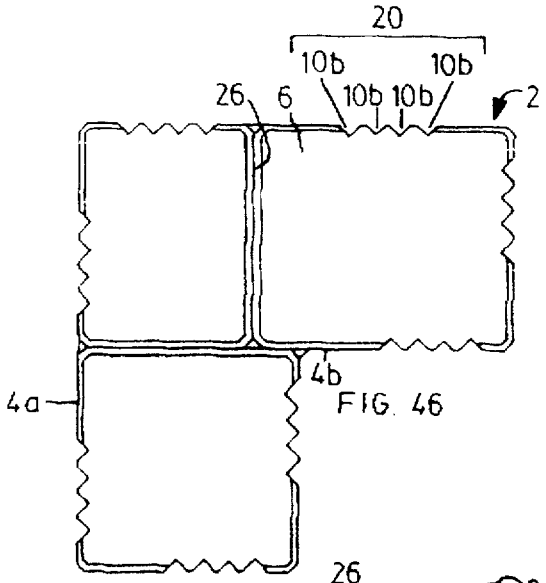

In FIG. 46, each set of recesses 20 includes four triangular recesses 10*b* asymmetrically disposed on sides 4*a* and 4*b*.

Figure 47:
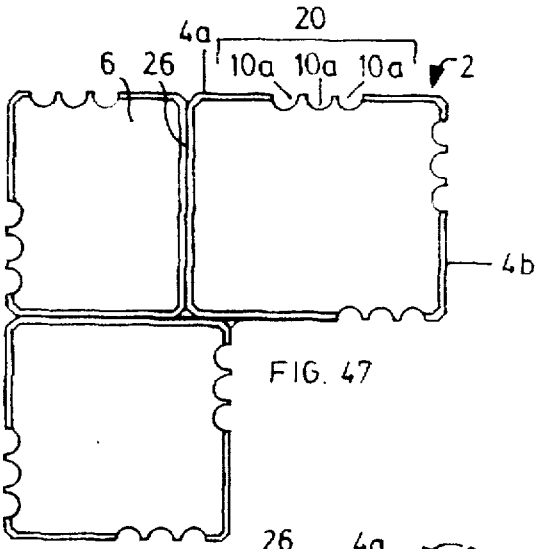

A first variant of the fifth embodiment shown in FIG. 47 is similar to that shown in FIG. 46, however, each set of recesses 20 includes three semicylindrical recesses 10*a*.

Figure 48:
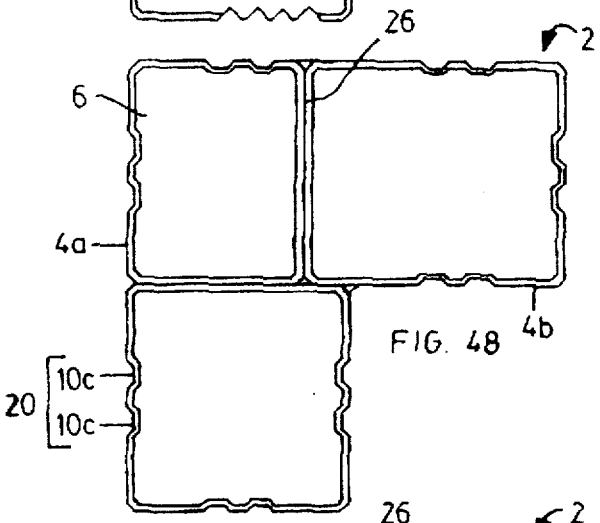

In a second variant to the fifth embodiment shown in FIG. 48, each set of recesses 20 includes a pair of trapezoidal recesses 10*c* symmetrically disposed on sides 4*a* and 4*b*.

Figure 49:
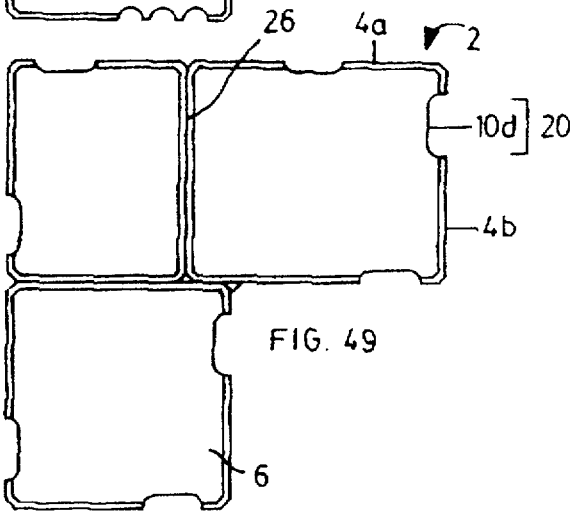

In a third variant to the fifth embodiment shown in FIG. 49, each set of recesses 20 includes a rectangular recess 10*d* having part-cylindrical end walls asymmetrically disposed on sides 4*a* and 4*b*.

Figure 50:
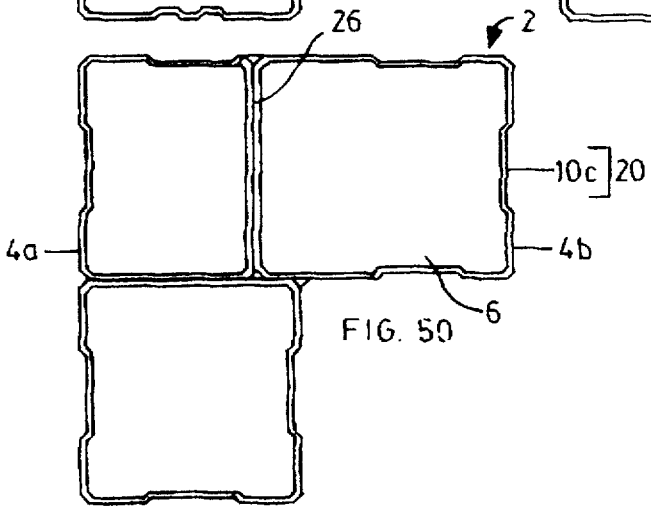

In a fourth variant of the fifth embodiment shown in FIG. 50, each set of recesses 20 includes an elongate trapezoidal recess 10*c* symmetrically disposed on sides 4*a* and 4*b*.

Figure 51:
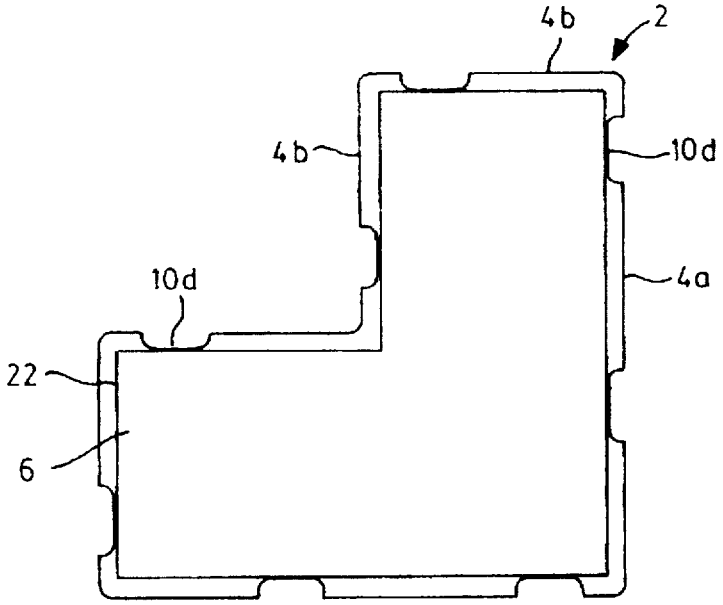
Figure 52:
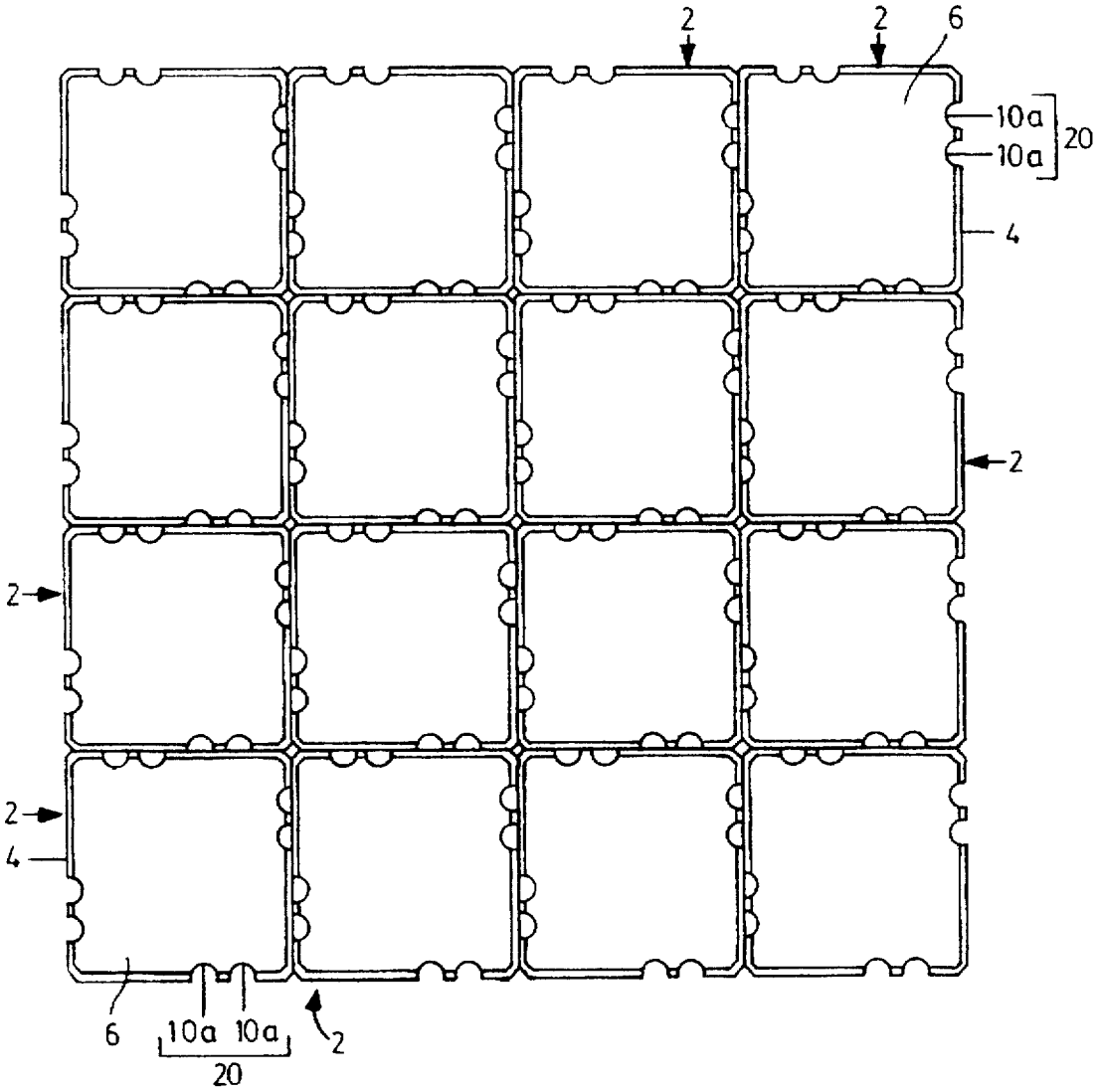
FIG. 52 is a plan view of a paved surface constructed with the paving elements of FIG. 1.

FIG. 51 illustrates an L-shaped artificial stone 2 having two recesses 10*d* on the long sides 4*a*, and a single recess 10*d* on the short sides 4*b*. The peripheral bevel 22 is configured such that the recesses 10*d* are provided in the region of the bevel 22 only, and thus connect with a plane that is deeper compared with the upper surface 6.

In another aspect of the present invention, an offset of the recesses 10 on neighboring stones 2 can also be accomplished by laying the stones 2 in a displaced or staggered manner. By laying the stones 2 in this manner, stones 2 having the recesses 10 symmetrically disposed along sides 4 may be used. Accordingly, such a surface could easily be constructed using any of the elements of FIGS. 6–9, 11–16, 18–19, 21–22, 24, 26, 32, 35, 38–39, 45, 48 and 50–51.

FIG. 52 shows a paved surface constructed in accordance with the first aspect of the present invention utilizing the paving elements of FIG. 1. It can be seen that the recesses 10*a* of neighboring stones 2 do not lie adjacent to one another and thus do not impair the unrestricted traffic-carrying capacity of the surface. At the same time, the total open cross-section provides for the sufficient drainage of surface water. FIG. 52 also shows that the recesses do not disturb the character of the laid configuration, and perhaps accentuate what can be regarded as quite desirable.

With reference to FIG. 52, it should be apparent that a paved surface can be made using only stones 2 of the kind provided by the invention, however, it is also possible that stones without such recesses 10 be included. The only essential requirement is that, over the entire paved surface, the total cross-section of the recesses is sufficient to handle the expected amount of surface water.

In addition, it is self-evident that the recesses can be filled with mineral material, such as sand, stone chips, etc., in order to further blur their appearance. However, it can also be quite advantageous to omit such filling, in order to facilitate the drainage of surface water. Such filling of the recesses is, in any event, not necessary for the surface to have a good traffic-bearing capacity.

The present invention has been described in terms of preferred embodiment thereof. Other embodiments, features and variations within the scope of the appended claims will, given the benefit of this disclosure, occur to those having ordinary skill in the art.

We claim:

1. A paving element for the water-permeable reinforcement of surfaces, said paving element comprising;

a top surface; and a plurality of sides, at least one of said sides having at least one vertical recess extending from said top surface, said at least one recess being disposed asymmetrically about a mid point of said at least one side; and, wherein said at least one recess provides a channel for the drainage of water from the top surface.

2. The paving element of claim 1 wherein said paving element is formed of artificial stone.

3. The paving element of claim 2 wherein said artificial stone is concrete.

4. The paving element of claim 1 further comprising a bevel formed in an upper edge of said sides.

5. The paving element of claim 4 wherein said at least one recess extends into said bevel and does not extend into said upper surface.

6. The paving element of claim 1 wherein said paving element is formed to have a polygonal horizontal cross-section.

7. The paving element of claim 6 wherein said horizontal cross-section is a square.

8. The paving element of claim 6 wherein said horizontal cross-section is a rectangle.

9. The paving element of claim 6 wherein said horizontal cross-section is a hexagon.

10. The paving element of claim 6 wherein said horizontal cross-section is an L-Shape.

11. The paving element of claim 1 wherein said top surface has a center point and a periphery edge, said paving element further comprising a plurality of radial grooves formed in said top surface extending from said center point to said periphery edge.

12. The paving element of claim 1 further comprising at least one false seam formed in said top surface.

13. The paving element of claim 1 wherein said at least one recess has a semicircular horizontal cross-section.

14. The paving element of claim 1 wherein said at least one recess has a triangular horizontal cross-section.

15. The paving element of claim 1 wherein said at least one recess has a trapezoidal horizontal cross-section.

16. The paving element of claim 1 wherein said at least one recess has a rectangular horizontal cross-section.

17. The paving element of claim 1 wherein said at least one recess has a rectangular horizontal cross-section with rounded part-circular ends.

18. A paving element for the water-permeable reinforcement of surfaces, said paving element comprising:

a top surface; and a plurality of sides, at least one of said sides having at least one set of recesses disposed asymmetrically about a mid point of said at least one side, each set of recesses having at least one vertical recess extending from said top surface and wherein said recesses provide channels for the drainage of water from the top surface.

19. The paving element of claim 18 wherein said at least one set of recesses includes a plurality of vertical recesses extending from said top surface to said bottom surface.

20. The paving element of claim 19 wherein said plurality of vertical recesses have the same horizontal cross-sectional shape.

21. The paving element of claim 19 wherein said plurality of vertical recesses have different horizontal cross-sectional shapes.

22. The paving element of claim 21 wherein said plurality of vertical recesses includes a largest vertical recess, said largest vertical recess having the greatest horizontal cross-sectional area of said plurality of vertical recesses, wherein said largest vertical recess is centrally disposed in relation to said plurality of vertical recesses.

23. A paved surface comprising a plurality of paving elements, said paving element comprising:

a top surface; and a plurality of sides, at least one of said sides having at least one vertical recess extending from said top surface;

wherein the recesses of juxtaposed sides of neighboring paving elements are offset from one another, thereby avoiding registry of said recesses; and, wherein said least one recess provides a channel for the drainage of water from the top surface.

24. A paving element for the water permeable reinforcement of surfaces, such paving element comprising:

a top surface; and a plurality of sides, at least one of said sides having at least one set of recesses disposed asymmetically about a mid-point of said at least one side, each set of recesses including a plurality of vertical recesses extending from said top surface for the drainage of water from said top surface;

wherein said plurality of vertical recesses have different horizontal cross-sectional areas; and wherein said plurality of vertical recesses includes a largest vertical recess, said largest vertical recess having the greatest horizontal cross-sectional area of said plurality of vertical recesses, wherein said largest vertical recess is centrally disposed in relation to said plurality of vertical recesses.

* * * * *